United States Patent [19]

Shung

[11] 4,346,788

[45] Aug. 31, 1982

[54] TAILORABLE DISCRETE OPTICAL SENSOR

[75] Inventor: Wu S. Shung, South Windsor, Conn.

[73] Assignee: Otis Elevator Company, Farmington, Conn.

[21] Appl. No.: 93,474

[22] Filed: Nov. 13, 1979

[51] Int. Cl.[3] ..... B66B 1/40

[52] U.S. Cl. ..... 187/29 R; 340/21

[58] Field of Search ..... 187/29; 340/19, 21, 340/146.3 G; 250/229

[56] References Cited

U.S. PATENT DOCUMENTS

| | | | |
|---|---|---|---|
| 2,410,550 | 11/1946 | Padua | 250/229 |
| 3,414,088 | 12/1968 | Bruns et al. | 187/29 |
| 3,483,950 | 12/1969 | Simpson | 187/29 |
| 3,749,203 | 7/1973 | Hoelscher | 187/29 |
| 3,815,711 | 6/1974 | Hoelscher | 187/29 |
| 3,963,098 | 6/1976 | Lewis et al. | 187/29 |

*Primary Examiner*—J. V. Truhe

*Assistant Examiner*—W. E. Duncanson, Jr.

*Attorney, Agent, or Firm*—M. P. Williams

[57] ABSTRACT

A discrete position encoder having a plurality of spaced apart pairs of optical sources and detectors, thereby providing a plurality of interruptible light beams, mounted on one member, cooperating with a light-occluding vane which is mounted on another member movable relative to the first member, there being at least two of the detectors which are not occluded while at least two other detectors are occluded when the two members are relatively centrally aligned with each other, the vane having a notch therein centrally disposed along the vane in the direction of relative motion, the notch being relatively adjustable in size by means of adding additional membranes, such as self-sticking plastic sheet or the like, to the vane to alter the light-occluding capacity of the notch, thereby to tailor the response of the detectors to the effective notch caused by the altering.

1 Claim, 4 Drawing Figures

TAILORABLE DISCRETE OPTICAL SENSOR

DESCRIPTION

1. Technical Field

This invention relates to position transducers, and more particularly to discrete optical transducers having a plurality of optical paths interruptible by a vane, in which the vane has a notched portion that can be effectively tailored by the addition of membranes thereto. The invention has suitability for use in applications employing discrete positional zones, particularly those which are bidirectionally symmetrical with respect to mutual alignment, such as used in positioning elevator cars with respect to a plurality of floor landings.

2. Background Art

In a commonly owned copending application filed on even date herewith by Robert E. Fairbrother entitled DISCRETE POSITION LOCATION SENSOR, Ser. No. 093,475, there is disclosed a transducer in which an opaque vane interrupts optical beams to encode discrete positional zones, such as may be used in locating an elevator car with respect to floor landings. The principal aspects of that invention are that bidirectionally symmetrical zones are decoded with relatively few detector elements (such as light beams) with a vane which causes the centrally aligned position to have at least two detectors in one state and at least one other detector in another state, whereby failure modes may be self-checked. And, that application also concerns itself with dual rows of detectors to allow flexibility in the original design of independently sized positional zones. However, the aforementioned copending application does not provide for post-manufacture tailoring of the relationship between the vane and the detectors.

DISCLOSURE OF INVENTION

The object of the invention is to provide post-manufacture tailoring of a light-occluding vane in a discrete, positional zone, optical position detector.

According to the invention, a discrete position optical detector in which the relative position of two relatively movable members is determined by the pattern of occluded light beams, the light beams being between sources and sensors on one of the members, the occlusion being effected by a light-occluding vane on the other member, the particular configuration of the vane including a notch, the notch being tailorable by adding adhesive sheets or the like thereto after the vane is manufactured or installed, thereby to permit post-manufacture tailoring of the relationship of light occlusion to the optical paths on the other member.

The present invention provides particular utility in tailoring an optical encoder of the type which may be used in elevator systems: an optical unit including a plurality of interruptible light beams being mounted on a C-shaped member on the elevator car, and a light-occluding vane, having a notch therein, being mounted on the building. The invention is directed toward being able to adjust the light-occluding characteristic of the vane, in a mechanically viable fashion, after installation in a building, such as by utilizing self-adhering plastic sheets or webs to reduce the size of the light-passing notch in the light-occluding vane.

The foregoing and other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
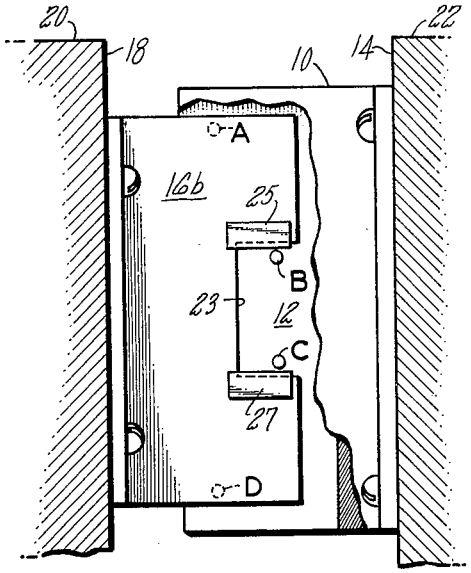
FIG. 1 is a side elevation view, partially broken away, of a first embodiment of the present invention.
Figure 2:
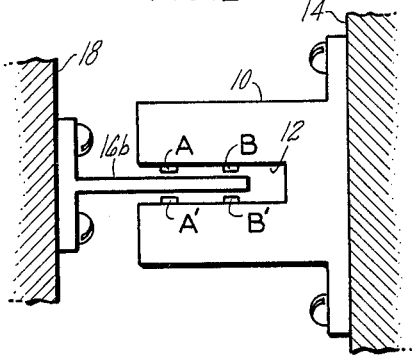
FIG. 2 is a top plan view of the embodiment of the invention illustrated in FIG. 1.

Referring now to FIGS. 1 and 2, a first embodiment of the invention comprises a generally C-shaped optical member 10 having a plurality of optical sensors A–D disposed thereon at one side of a slot 12 therein, with corresponding optical sources A′, B′ mutually aligned on the opposite side of the slot 12 from the related sensors A, B. The optical unit 10 is fixed to a member 14, such as an elevator when the invention is used in a hoistway, or any other member with which the present invention is to be utilized.

A vane **16*b* is disposed on the fixed member 18, such as the wall of a hoistway in an elevator system, when the invention is used to determine the position of an elevator with respect to a plurality of floors; in such case, a plurality of vanes 16 would normally be provided since they are relatively inexpensive, only one optical unit 10 being provided on the elevator car, each vane 16*b* being suitably disposed with respect to the landing of each floor in the hoistway, the optical unit 10 being disposed with respect to the floor 22 of the elevator (as illustrated in FIG. 1) so that the relative positioning of the optical unit 10 and the vane 16 is an indication of the position of the elevator with respect to the landing floor 20. The vane 16 is opaque, and as illustrated in FIG. 1, will occlude the optical sensors A, D, but a notch 23 in the vane 16*b* will prevent occluding the optical sensors B, C, when the vane is centrally aligned with the unit 10, as is illustrated in FIG. 1. The object of the invention is the capability of adjusting the size of the notch 23, such as by means of adherent sheets of opaque material 25, 27 while maintaining a relative degree of mechanical viability that is useful in a hostile environment. This is in contrast with the difficulty involved in causing a stepped vane, of the type illustrated in FIG. 1** of the copending application, to be similarly tailored after manufacture.

Figure 3:
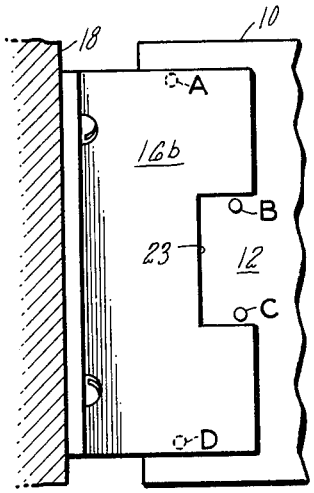
FIG. 3 is a partial side elevation view of a second embodiment of the present invention.

In FIG. 1, the optical paths relating to the detectors A, D are disposed in one row which is parallel to a second row in which the optical detectors B, C are disposed. This is in conformance with the invention disclosed and claimed in the aforementioned copending application. However, the invention may be practiced, as is illustrated in FIG. 3, with all of the detectors A–D mounted in the same row. In either of these cases, the optical encoding, with failure mode detection, may be practiced as is described with respect to FIG. 5 of the aforementioned copending application.

Figure 4:
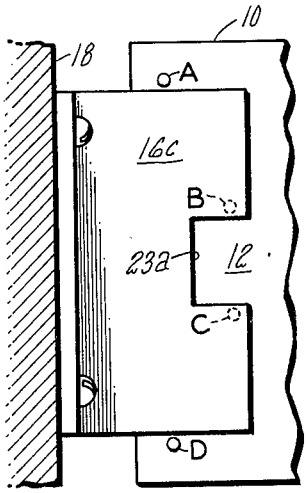
FIG. 4 is a partial side elevation view of a third embodiment of the present invention.

An additional embodiment of the present invention, which is not generally to be favored, is illustrated in FIG. 4. Therein the notch **22*a* is smaller than that necessary to allow both of the detectors B, C to be operative, and the overall length of the vane 16*c* is small enough to allow both of the detectors A, D to be operative, when the vane and the optical unit 10 are mutually, centrally aligned as illustrated in FIG. 4. This provides a somewhat different code than is described in the aforementioned application, utilizing more of the possible code combinations on the ON/OFF states of the detectors A–D for more zones, but less than a full number of decoded failure states, and therefore may not be suitable for use in applications where failure mode detection is important. FIG. 4 illustrates, however, that the notched vane suitable for tailoring, to be used in conjunction with the present invention, may take a variety of configurations, in addition to those illustrated in FIGS. 1 and 3**.

In practice, the notch 23, 23*a* may typically be made larger than ordinary design considerations would indicate, to permit fine tailoring of the vane after installation in an elevator system, or to permit having a common-type of vane manufactured for use in a wide variety of systems, each vane being tailored for a particular building or other application by means of adjustment or tailoring of the effective light-passing notch area by means of adhering additional sheets thereto, such as the sheets 25, 27 illustrated in FIG. 1.

Obviously, the idea of post-manufacture tailoring of the size of a light-passing notch in a light-occluding vane can take a wide variety of forms and can utilize a wide variety of different types of additional opacity (not being limited to self-adhering plastic sheets) while utilizing the principles of the present invention.

Thus, although the invention has been shown and described with respect to exemplary embodiments thereof, it should be understood by those skilled in the art that the foregoing and various other changes, omissions and additions may be made therein and thereto without departing from the spirit and the scope of the invention.

I claim:

1. A position encoder comprising first and second members relatively movable with respect to each other, said first member having disposed thereon a plurality of optical sources and sensors to form a plurality of discrete optical beams, said second member comprising a light-occluding vane of opaque material having a notch which is centrally disposed therein with respect to the direction of relative motion of the two members, the size of the vane and the size of the notch therein relative to the position of the optical sensors being such as to establish a pattern of ON/OFF states of the sensors which define a plurality of symmetrical positional zones including zones on opposite sides of mutual central alignment of said two members, in either direction of relative motion of said two members, said notch serving to provide a capability for altering the effective opacity of a central portion of said vane by means of adding additional light-occluding material to said vane near the edges of said notch.

* * * * *